US008082767B2

(12) United States Patent
Sasaki et al.

(10) Patent No.: US 8,082,767 B2
(45) Date of Patent: Dec. 27, 2011

(54) LUBRICANT FOR HOT METAL WORKING AND POWDER LUBRICANT COMPOSITION FOR HOT METAL WORKING

(75) Inventors: Kenichi Sasaki, Osaka (JP); Sumio Iida, Osaka (JP); Shizuo Mori, Kanagawa (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 603 days.

(21) Appl. No.: 12/293,391

(22) PCT Filed: Mar. 23, 2007

(86) PCT No.: PCT/JP2007/056019

§ 371 (c)(1),
(2), (4) Date: Dec. 30, 2008

(87) PCT Pub. No.: WO2007/116653

PCT Pub. Date: Oct. 18, 2007

(65) Prior Publication Data

US 2009/0205392 A1 Aug. 20, 2009

(30) Foreign Application Priority Data

Mar. 27, 2006 (JP) ..... 2006-086753

(51) Int. Cl.
*B21B 45/02* (2006.01)
*C10M 173/02* (2006.01)

(52) U.S. Cl. ..... 72/42; 72/96; 72/97; 72/370.01; 524/837

(58) Field of Classification Search ..... 72/42, 43, 72/68, 96, 97, 370.01, 100; 524/143, 837, 524/838

See application file for complete search history.

(56) References Cited

U.S. PATENT DOCUMENTS

| | | | | |
|---|---|---|---|---|
| 2,990,610 | A * | 7/1961 | Luckerath et al. | 72/42 |
| 3,915,870 | A * | 10/1975 | Brown | 72/42 |
| 4,402,838 | A * | 9/1983 | Eguchi et al. | 72/42 |
| 5,537,849 | A * | 7/1996 | Kawakami et al. | 72/43 |
| 5,584,945 | A * | 12/1996 | Nittel et al. | 72/42 |
| 5,859,124 | A * | 1/1999 | Yorifuji et al. | 524/837 |
| 5,983,689 | A * | 11/1999 | Yorifuji et al. | 72/42 |
| 2009/0178454 | A1 * | 7/2009 | Komiyama et al. | 72/42 |
| 2009/0293569 | A1 * | 12/2009 | Saito et al. | 72/42 |

FOREIGN PATENT DOCUMENTS

| | | |
|---|---|---|
| JP | 64-16894 | 1/1989 |
| JP | 4-108900 | 4/1992 |

(Continued)

OTHER PUBLICATIONS

International Search Report in corresponding PCT/JP2007/056019 dated Jun. 26, 2007.

*Primary Examiner* — David Jones
(74) *Attorney, Agent, or Firm* — Marshall, Gerstein & Borun LLP

(57) ABSTRACT

The present invention provides a lubricant for hot metal working which is capable of inhibiting generation of white scale, attributed to the lubricant, on the surface of a workpiece material and is capable of improving lubricity to obtain favorable appearance of the finished product. The lubricant for hot metal working comprises a silicate compound used for adding to a lubricant composition mainly containing sodium borate.

7 Claims, 1 Drawing Sheet

FOREIGN PATENT DOCUMENTS

| | | |
|---|---|---|
| JP | 5-171165 | 7/1993 |
| JP | 6-41567 | 2/1994 |
| JP | 9-780080 | 3/1997 |
| JP | 10-121088 | 5/1998 |
| JP | 2002-338984 | 11/2002 |
| JP | 2002-338985 | 11/2002 |
| JP | 2006-182927 | 7/2006 |

* cited by examiner

LUBRICANT FOR HOT METAL WORKING AND POWDER LUBRICANT COMPOSITION FOR HOT METAL WORKING

TECHNICAL FIELD

The present invention relates to a lubricant for hot metal working used for adding to a lubricant composition containing sodium borate as a main component. Particularly, the present invention relates to a lubricant for hot metal working used for adding, in mandrel mill rolling which is one of the steps for manufacturing a seamless pipe or tube (hereinafter, referred to "pipe" as "pipe or tube"), to a lubricant composition mainly containing sodium borate; a method for inhibiting crystallization of the lubricant composition using the lubricant for hot metal working; a powder lubricant composition for hot metal working containing the lubricant; and a method for manufacturing seamless pipes using the lubricant composition.

BACKGROUND ART

In the method for manufacturing a seamless pipe, a "billet" as a raw material is heated in a heating furnace, and then it is made into a hollow shell by piercing-rolling using a piercer. The hollow shell is processed to adjust its pipe wall thickness by mandrel mill rolling. Thereafter, for example, outer working of the hollow shell is done by an extractor sizer to form a finished pipe product.

In the mandrel mill rolling, a mandrel bar is inserted into a hollow shell which has been treated by piercing-rolling and is set at a high temperature within the range between 1000 and 1300° C., and then, drawing-rolling of the hollow shell is carried out, for instance, by a pair of caliber rolls set at 90 degree of phase difference in seven to eight tandemly-placed mandrel mills. When drawing-rolling the hollow shell, relative slippage happens between the inner surface of the hollow shell and outer surface of the mandrel bar. So, in the mandrel mill rolling, so as the relative slippage to be smoothly developed, lubrication in the working interface has to be favorably secured. Accordingly, by applying a lubricant in the working interface and securing low and stable friction coefficient, seizure between the hollow shell and the mandrel bar is inhibited so that favorable inner-surface quality and dimensional accuracy of the finished pipe product can be obtained.

There are mainly two examples of method for lubricating working interface, i.e., a method by adhering a lubricant onto the surface of mandrel bar; and the other method by adhering a lubricant to the inner surface of the hollow shell. As the method by adhering a lubricant onto the surface of mandrel bar, a method having the steps of: applying a water dispersive lubricant mainly containing black lead and a resin-series organic binder to the surface of mandrel bar before inserting it into the hollow shell; and drying the water dispersive lubricant to form a solid lubricating coating on the surface of mandrel bar.

On the other hand, as a lubricant to be used for adhering onto the inner surface of the hollow shell, hitherto, various lubricants have been studied; however, none of them shows sufficient effects. Particularly, technology about mandrel mill rolling has been developed and retained-mandrel mill rolling for keeping the speed of bar under rolling constant has been spread; however, in the retained-mandrel mill rolling, load to the mandrel bar is large so that conventional lubricant cannot meet the required lubricity and inner-surface quality of the finished pipe product.

Further, in a full-retractable mandrel mill which becomes popular these years, a short mandrel bar is used for drawing-rolling a long pipe product. So, reduction of friction coefficient becomes necessary and load to a mandrel bar becomes larger with the conventional lubricant; whereby seizure tends to occur, which deteriorates the inner-surface quality of the pipe product.

Because of this, in order to reduce friction between hollow shell and mandrel bar by making properties of the lubricant in powder state favorable and making the lubricant evenly applicable to the predetermined area when applied onto the inner surface of the hollow shell, Patent Document 1 proposes a powder lubricant composition for hot metal working which contains sodium borate pentahydrate as a main component and sodium carbonate and the like as a supplemental lubricant.

When mandrel mill rolling is carried out using the powder lubricant composition for hot metal working described in Patent Document 1, as the powder lubricant composition is not only excellent in handleability and workability but also able to reduce friction between the hollow shell and the mandrel bar at a time of rolling, it is possible to reduce flaws produced on the inner surface of the finished pipe product.

Chromium-plated surface of the mandrel bar is usually covered with chromium oxide, namely, surface of the chromium-plate becomes passivity so that the mandrel bar is in a state hardly corrosive. But, when surface of the mandrel bar and a substance like sodium borate which melts metal oxide are contacted each other at high temperature, chromium oxide in the surface of the chromium-plate is melted and a kind of corrosive wear is sometimes caused.

In order to solve the problem, Patent Document 2 proposes a powder lubricant composition for hot metal working containing sodium borate, which is capable of inhibiting corrosive wear of chromium layer on the surface of the mandrel bar but also capable of prolonging the life of tools. When mandrel mill rolling is carried out by using the powder lubricant, it is possible to inhibit corrosive wear of chromium-plate surface and to prolong the life of hot-metal-working tools; it is also possible to favorably and stably maintain the inner-surface quality of the finished pipe product.

Patent Document 1: Japanese Patent Application Laid-Open (JP-A) No. 2002-338984

Patent Document 2: JP-A No. 2002-338985

DISCLOSURE OF THE INVENTION

Problems to be Solved by the Invention

The powder lubricant compositions for hot metal working described in Patent Documents 1 and 2 contain sodium borate as a main component and sodium carbonate as a supplemental lubricant. In the mandrel mill rolling, when the lubricant composition is adhered to the inner surface of the hollow shell of which temperature is as high as 1000 to 1300° C., the lubricant composition is immediately melted down and spread on the work surface while melting a generated scale existing thereon. And, each time the hollow shell rotates during the drawing-rolling, lubricant composition can be furthermore evenly dispersed. Hence, the lubricant composition exhibits favorable lubricity; thereby it is possible to constantly obtain a finished pipe product without making flaws on the inner surface.

However, when mandrel mill rolling is carried out by using the powder lubricant composition for hot metal working described in Patent Documents 1 and 2, granular or lamellar white fouling (hereinafter, refer to as "white scale".) is sometimes generated on the inner surface of the finished pipe product.

This white scale does not affect to any properties of the finished product, however it deteriorate its appearance. So, the white scale has been removed by shot blasting the pipe's inner surface. Nevertheless, cumbersome treatment steps and large amounts of cost are necessary. Moreover, to further improve the lubricity to improve inner-surface quality of the finished pipe product is an issue that is always required in this field.

Accordingly, an object of the present invention is to provide a lubricant for hot metal working which is capable of inhibiting generation of white scale, attributed to the lubricant, on the surface of a workpiece material and is capable of making the appearance of the finished product favorable; a method for inhibiting crystallization using the lubricant for hot metal working; a powder lubricant composition for hot metal working containing the lubricant for hot metal working; and a method for manufacturing seamless pipe using the lubricant composition, in order to solve the above problems.

Means for Solving the Problems

In order to solve the above problems, the inventors had intensively studied the cause of white scale generated on the workpiece material, for example, white scale generated on the inner surface of the finished pipe product after mandrel mill rolling. As a result, they have discovered the fact that sodium borate crystallizes itself to become white scale in the lubricant composition containing sodium borate as a main component. Further, the inventors have also discovered that the above problems can be solved by adding certain components to a lubricant mainly containing sodium borate. And, they finally completed the below-described lubricant for hot metal working of the present invention which contains certain components, and lubricant composition containing the same.

The first aspect of the present invention is a lubricant for hot metal working comprising a silicate compound used for adding to a lubricant composition mainly containing sodium borate.

The lubricant for hot metal working of the first aspect of the invention is suitably used, in the mandrel mill rolling for drawing-rolling a hollow shell, for adding to a lubricant for inner surface lubrication used by adhering onto the inner surface of the hollow shell.

In the first aspect of the invention, the silicate compound is preferably a lamellar silicate compound.

The second aspect of the present invention is a method for inhibiting crystallization of a lubricant composition comprising the step of: in the mandrel mill rolling for drawing-rolling a hollow shell, adding a lubricant for hot metal working comprising a silicate compound to a lubricant composition for inner surface lubrication by adhering on the inner surface of the hollow shell.

In the second aspect of the invention, the silicate compound is preferably a lamellar silicate compound.

The third aspect of the present invention is a powder lubricant composition for hot metal working comprising: a first component being one or more compounds selected from a group consisting of anhydride, pentahydrate, and decahydrate of sodium borate; a second component comprising calcium carbonate and/or lithium carbonate; a third component comprising fatty acid sodium salt and/or fatty acid calcium salt; and a fourth component containing a lubricant for hot metal working comprising a silicate compound, wherein the content ratio of each component, to total mass of the first to fourth components as 100%, is: 30 to 80 mass % of the first component; 0 to 15 mass % of the second component; 5 to 15 mass % of the third component; and 10 to 40 mass % of the fourth component.

The lubricant for hot metal working in the third aspect of the invention is preferably the lubricant for hot metal working of the first aspect of the invention.

The fourth aspect of the present invention is a method for manufacturing seamless pipe comprising the steps of: in the manufacturing method for seamless pipe having a step of drawing-rolling a hollow shell, adhering the powder lubricant composition for hot metal working according to the third aspect of the invention onto the inner surface of the hollow shell; and drawing-rolling the hollow shell.

EFFECTS OF THE INVENTION

The lubricant for hot metal working of the present invention is used for adding into the lubricant composition mainly containing sodium borate and which is capable of inhibiting the generation of white scale, on the surface of finished product, attributed to the lubricant.

BEST MODE FOR CARRYING OUT THE INVENTION

<Lubricant for Hot Metal Working>

Figure 1:
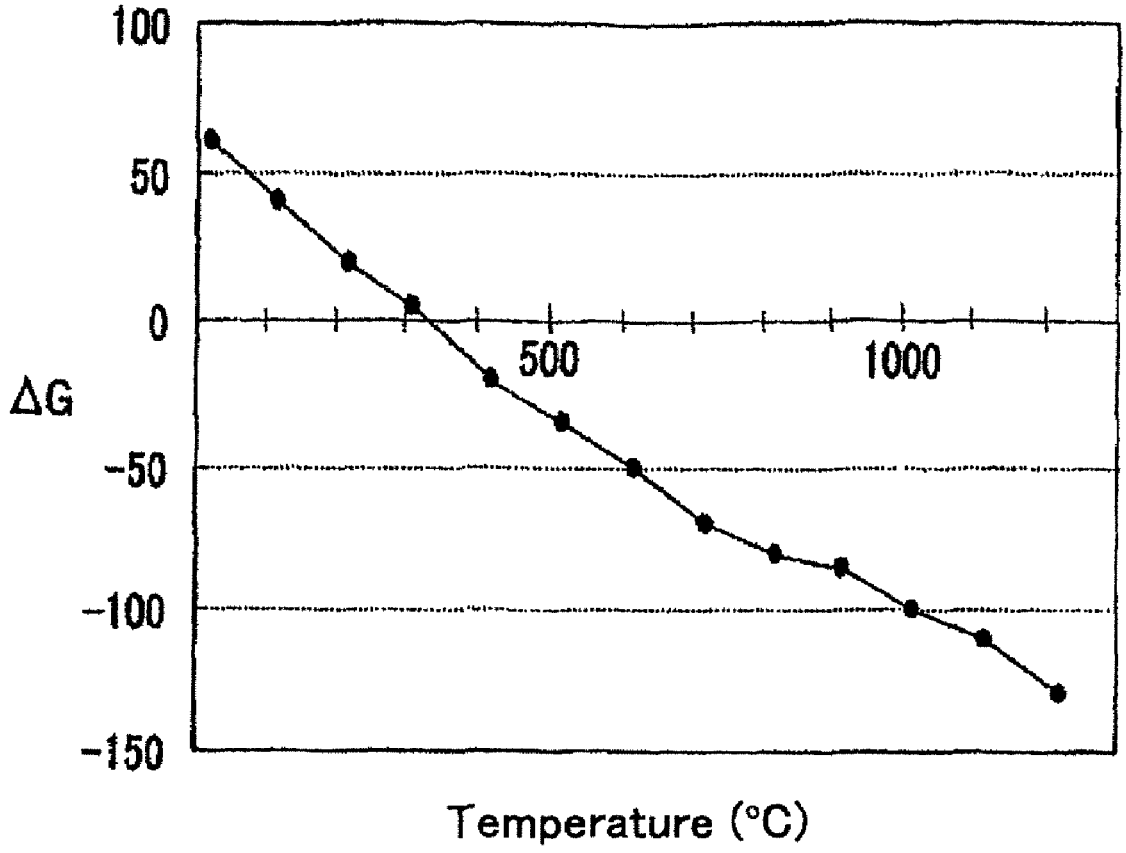
FIG. 1 is a graph showing a reaction temperature range of crystallization of sodium borate with sodium carbonate calculated from Gibbs free energy.

A lubricant for hot metal working of the present invention comprises a silicate compound. The silicate compound means a compound constituted by metal oxide and silicon oxide; examples of the metal constituting the metal oxide include aluminum, iron, calcium, magnesium, sodium, and potassium. As the silicate compound, one of which $SiO_2$ content is preferably 40 mass % or more, more preferably 50 mass % or more may be used. Among the silicate compound, in the invention, lamellar silicate compound can be preferably used. Lamellar silicate is relatively soft so that when it is added into the lubricant composition it exhibits the effects of lowering friction coefficient and improving lubricity. Accordingly, the lamellar silicate can lower friction coefficient between hot-metal-working tool and workpiece material, prolong the life of hot-metal-working tool, and inhibit production of flaws on the surface of worked material. Examples of lamellar silicate compound include: talc, pyrophyllite, mica (e.g. bearing brown mica, sericite, sodium tetrasilicic mica, potassium tetrasilicic mica, fluorine bearing mica), kaolin, and montmorillonite. The lubricant for hot metal working of the invention contains one kind or a combination of two kinds or more of these silicate compounds. Moreover, if process like granulation is necessary, in the range where does not affect the effects of the present invention, as an aquaresin, salts or the like of sodium carboxymethyl cellose, polyvinyl alcohol, and acrylic acid may be contained.

The lubricant for hot metal working of the present invention is used for adding to a lubricant composition, used for hot metal working, mainly containing sodium borate. By adding the lubricant for hot metal working of the invention, it is capable of inhibiting generation of white scale, on the surface of the workpiece material, attributed to the lubricant composition. A typical example of the hot metal working using the lubricant composition mainly containing sodium borate is mandrel mill rolling. In the mandrel mill rolling, lubricant composition mainly containing sodium borate is used as a lubricant by adhering to the inner surface of the hollow shell. The lubricant composition for hot metal working which is adhered onto the inner surface of the hollow shell is melted at a time of hot-rolling and spread over the work surface with melting the scale on the work surface in order to function as a lubricant. Thereafter, when the worked material is cooled, some lubricant composition remains on the inner surface of the hollow shell, the remained lubricant composition is in a form of amorphous and transparent; therefore it does not damage the appearance of the finished pipe products.

However, when a certain period of time passes after the manufacturing of finished pipe product, white scale is sometimes generated on the inner surface of the finished pipe product. The inventors assume that the cause of generation of the white scale is because of the crystallization of sodium borate in the lubricant composition for hot metal working. And, the lubricant for hot metal working of the invention is capable of inhibiting generation of white scale as it is assumed to melt together with sodium borate and produce an amorphous form which is difficult to crystallize after cooling of the worked material. The mechanism of crystallization of sodium borate will be described below.

<Method for Inhibiting Crystallization>

The method for inhibiting crystallization of the present invention comprises the step of: adding the above-described lubricant for hot metal working to a lubricant composition, used in the hot metal working, mainly containing sodium borate so as to inhibit crystallization of sodium borate in the lubricant composition. According to the method, for instance, when rolling a hollow shell by mandrel mill, in a case where the lubricant composition mainly containing sodium borate is adhered on the inner surface of the hollow shell, the crystallization of the sodium borate existing in the lubricant composition on the inner surface of the finished pipe product is inhibited; even in case where the finished pipe product is left undisturbed for a certain period, it is capable of inhibiting generation of white scale on the inner surface of the finished pipe product.

The method for adding the lubricant for hot metal working to the lubricant composition may be carried out by mixing, in advance, the lubricant composition mainly containing sodium borate and the lubricant for hot metal working of the invention, and then applying the mixture onto the inner surface of the hollow shell; or it may be carried out by separately applying the lubricant composition and the lubricant for hot metal working onto the inner surface of the hollow shell. Even when the lubricant composition and the lubricant for hot metal working are applied separately, these are melted and mixed each other in the hot metal working to produce an amorphous form which is difficult to crystallize after cooling of the worked material.

An example of method for adhering the powder lubricant composition onto the inner surface of the hollow shell is a method where a powder lubricant composition is blown with the injection of carrier gas consisting of nitrogen from one end of the hollow shell.

<Powder Lubricant Composition for Hot Metal Working>

The powder lubricant composition for hot metal working of the present invention contains a first component, a second component, a third component, and a fourth component. Each component will be individually described as follows. It should be noted that the second component is an optional component, so there are cases where it is and is not contained in the lubricant composition of the invention. Also, in the description below, a mode in which the powder lubricant composition for hot metal working of the invention is utilized for mandrel mill rolling for rolling a hollow shell is described; but the powder lubricant composition for hot metal working of the invention is not limited to this mode, it can be generally used for hot metal working using a powder lubricant composition.

(First Component)

The first component is the one kind or more compounds selected from a group consisting of: anhydride, pentahydrate, and decahydrate of sodium borate ($Na_2B_4O_7$). The first component is a component to mix for securing fluid lubricity and scale fusibility. The mixing ratio of the first component is preferably 30 to 80 mass % to total mass of the first to fourth components as 100 mass %.

If content of the first component is too small, adequate viscosity cannot be maintained, thereby performance of lubricity is inferior. On the other hand, if content of the first component is too large, friction coefficient cannot be reduced and that deteriorates properties of lubricant composition in a powder state (anti-solidification at a time of storage and fluidity at a time of transportation). From the above viewpoint, content of the first component is further preferably 40 to 70 mass %.

In the first component, sodium borate pentahydrate contains adequate amount of crystal water so that it moderately foams when adhered on the inner surface of the high-temperature hollow shell. As a consequence, the lubricant is moderately dispersed, therefore it is possible to evenly apply the lubricant to the entire inner surface. Moreover, sodium borate pentahydrate does not cause a problem of aggregation of powder at a time of storage because of the release of crystal water, property in a powder state (anti-solidification at a time of storage and fluidity at a time of transportation) is preferable.

Whereas, anhydrous salt of sodium borate does not contain crystal water, so it does not foam when adhered to the inner surface of a high-temperature hollow shell. Hence, when the powder lubricant composition is applied, there is no effect of dispersion of the powder lubricant composition by the foaming of crystal water; thereby even application of the powder lubricant composition to the entire inner surface may not be possible.

Further, decahydrate of sodium borate contains large quantity of crystal water; when the powder lubricant composition containing the decahydrate is adhered to the inner surface of a high-temperature hollow shell, the powder lubricant composition excessively foams. Accordingly, wind pressure is caused so that it becomes difficult to evenly adhere the powder lubricant composition to a predetermined area on the inner surface. Still further, when the powder lubricant composition is stored as a powder lubricant, decahydrate of sodium borate may release the crystal water, which sometimes makes sodium borate melt and aggregate. In such a case, clogging is caused in the piping for transporting the powder lubricant, which deteriorates the transportability.

As above, for the first component, mixing a sodium borate pentahydrate by itself or raising the mixing ratio of sodium borate pentahydrate is preferable.

(Second Component)

The second component is calcium carbonate and/or lithium carbonate. The second component is an optional component. The above sodium borate has fluid lubricity and scale fusibility but also exhibits favorable reactivity with workpiece material and imparts lubricity; however, it raises viscosity of the lubricant. So, as a supplemental lubricant, by mixing calcium carbonate and/or lithium carbonate, viscosity of the lubricant can be lowered. With the supplemental lubricant, the second component is capable of evenly dispersing the powder lubricant composition on the inner surface of the hollow shell, and capable of securing lubricity over the entire inner surface of the hollow shell. In addition, scale existing on the inner surface may become the cause of flaws generation in the inner surface; nevertheless, the second component has effects to immediately melt the scale and inhibit generation of flaws.

Moreover, since solubility in water of calcium carbonate and lithium carbonate as the second component is small, these prevent the powder lubricant composition remaining on the inner surface of finished pipe product after mandrel mill rolling from moisture absorption and inhibit crystallization of sodium borate, and still further inhibit generation of white scale on the inner surface.

The mixing ratio of the second component is preferably 15 mass % or less to total mass of the first to fourth components as 100 mass %. If content of the second component is too large, viscosity of the lubricant becomes too low, which deteriorates lubricity.

Conventional lubricant contains sodium carbonate instead of calcium carbonate and lithium carbonate as the second component of the present invention. When a lubricant having such a composition is used, white scale is generated on the inner surface of the finished pipe product. About the reason why white scale is generated when a conventional lubricant is used, assumption of the inventors of the invention will be described below.

Immediately after the mandrel mill rolling, in the powder lubricant composition adhered onto the inner surface of the high-temperature hollow shell, sodium borate reacted with the scale and excessively given sodium borate form a mixed state. After cooling, the mixture becomes solid as an amorphous lubricant. The amorphous lubricant is transparent.

However, the amorphous lubricant repeatedly absorbs moisture and dried itself, it eventually crystallize itself as $Na_2B_4O_7$. $5H_2O$ to form white scale.

As the support of mechanism of white scale generation, the fact that when sodium carbonate is contained as a supplemental lubricant, white scale generation becomes remarkable has been confirmed. This phenomenon can be explained by the reaction shown by the following formula (I).

$$Na_2B_4O_7+Na_2CO_3 \rightarrow 4NaBO_2+CO_2 \quad (1)$$

FIG. 1 is a graph showing a result of calculation of Gibbs free energy from the above formula (1). FIG. 1 shows reaction temperature range of crystallization of sodium borate with sodium carbonate and also shows the reaction develops to the right side under $\Delta G<0$ condition.

As seen from the result shown in FIG. 1, within the temperature range of about 350° C. or more, in other words, immediately after mandrel mill rolling, the reaction of the above formula (1) develops to the right side; therefore $NaBO_2$ is produced. Solubility of borate is shown in Table 1.

TABLE 1

| Chemical formula | Solubility (in 100 ml water) |
|---|---|
| $NaBO_2$ | 26 g (20° C.) |
| | 36 g (35° C.) |
| $Na_2B_4O_7$ | 1.3 g (0° C.) |
| (anhydride) | 8.79 g (40° C.) |

As shown in Table 1, compared with $Na_2B_4O_7$, $NaBO_2$ produced immediately after rolling has higher solubility so that it easily absorbs moisture and is crystallized after repeated moisture absorption and drying itself. Thereafter, during the storage of finished pipe product under room temperature, reaction of the above formula (1) develops to the left side; eventually, white scale is formed on the inner surface of the pipe in a state of $Na_2B_4O_7.5H_2O$.

Based on the above studies, the inventors had studied various supplemental lubricants to be used instead of sodium carbonate. As a result, the inventors determined to focus on calcium carbonate and lithium carbonate which exhibit excellent high-temperature fluidity and sufficient lubricity, as a supplemental lubricant.

Namely, same as sodium carbonate, calcium carbonate as a supplemental lubricant can lower viscosity of sodium borate and attain similar level of lubricity; meanwhile, the solubility in 100 mL water is 1.4 mg at 25° C. and 1.8 mg at 75° C., which is low.

Also, lithium carbonate as another supplemental lubricant, same as sodium carbonate, can lower viscosity of sodium borate and attain similar level of lubricity; meanwhile, the solubility in 100 mL water is 1.54 g at 0° C. and 0.73 g at 100° C., which is low.

As above, in the present invention, by using calcium carbonate and/or lithium carbonate as the second component, it is capable of inhibiting white scale which is assumed to be generated by that the lubricant repeatedly absorbs moisture, dry itself, and crystallize after mandrel mill rolling.

(Third Component)

The third component is a fatty acid sodium salt and/or a fatty acid calcium salt. Fatty acid sodium salt and fatty acid calcium salt are an essential component for the powder lubricant composition of the present invention to maintain preferable properties when stored. The dosage of the third component, to the total mass of the first to fourth components as 100 mass %, is preferably 5 to 15 mass %. If content of the third component is too small, when transporting the powder lubricant composition, it may not be possible to smoothly transfer the powder lubricant composition through the piping. On the other hand, if content of the third component is excessive, when the lubricant is given into the high-temperature hollow shell, the third component instantly burns and the combustion gas extraordinarily disperses the powder lubricant composition; thereby the powder lubricant composition sometimes removed from inside of the hollow shell to the outside. In this case, consequently, the adhesion quantity becomes small, which deteriorates lubricity. In addition, when the adhesion quantity is large, it is not economical.

Examples of fatty acid sodium salt and fatty acid calcium salt include: saturated fatty acid salts such as stearic acid, palmitic acid; fatty acid salts obtained from natural vegetable fat such as palm-oil fatty acid and fatty acid of palm kernel oil; and fatty acid salts obtained from animal fat such as beef tallow fatty acid.

(Fourth Component)

The fourth component is a lubricant for hot metal working comprising a silicate compound. As a lubricant for hot metal working of the fourth component, similar lubricant to the above lubricant for hot metal working of the invention may be used. The powder lubricant composition for hot metal working of the invention inhibits generation of white scale on the inner surface of finished pipe products by using calcium carbonate and/or lithium carbonate of the second component as a supplemental lubricant. Hence, the fourth component inhibits generation of white scale on the inner surface of finished pipe products from the different viewpoint of the second component.

According to the studies of the inventors, silicate compound as the fourth component and sodium borate as the first component are melted and mixed each other in the hot metal working; after cooling, the mixture forms an amorphous lubricant. This amorphous state formed by the mixture of the silicate compound and sodium borate is difficult to be crystallized so that generation of white scale is inhibited on the inner surface of the finished pipe products.

<Method for Manufacturing Seamless Pipe>

A method for manufacturing seamless pipe of the present invention comprises the steps of: adhering the above powder lubricant composition for hot metal working onto the inner surface of a hollow shell; making the powder lubricant composition lubricate between the inner surface of the hollow shell and a mandrel bar; and drawing-rolling the hollow shell. Overall process of the manufacturing method of seamless pipe is a normal method, which comprises, for example: piercing-rolling a billet by a piercer; forming a hollow shell; drawing-rolling the hollow shell by mandrel mill rolling; and thereafter, carrying out outer working by a sizer. The manufacturing method of the present invention is characterized in the step of mandrel mill rolling.

In the step of mandrel mill rolling, firstly, temperature of the hollow shell is set within the range between 1000 and 1300° C. If the temperature is too low, the powder lubricant composition of the invention cannot be melted, thereby lubricity cannot be shown. The upper limit of the hollow shell temperature is set by the melting point of the material of the hollow shell.

In the manufacturing method of the invention, the step of heating the hollow shell up to the above temperature may be introduced in the step of mandrel mill rolling; or the heating step may also be carried out by using residual heat of drawing-rolling with piercer.

The method for adhering the powder lubricant composition onto the inner surface of the hollow shell, for instance, may be done by injecting a carrier gas consisting of nitrogen to blow the powder lubricant composition from one end of the hollow shell.

The method for mandrel mill rolling may be retained-mandrel mill rolling or full-retractable mandrel mill rolling. Even if it is a method giving heavy load to the mandrel bar, with the excellent lubricity of the lubricant composition, it is capable of obtaining finished pipe product having favorable appearance.

EXAMPLES

Effects of the powder lubricant composition for hot metal working of the present invention now will be described in accordance with the evaluation results using electric furnace and the evaluation results under operation of actual production line.

Examples 1 to 12

Each component shown in Table 2 is fed into and mixed in the powder mixer to make the powder lubricant composition for hot metal working of the invention. Details of each component are as follows.

(First Component)

Sodium borate anhydrous salt: the average particle diameter is about 0.6 mm and the purity is 98% or more;

sodium borate pentahydrate: the average particle diameter is about 0.4 mm and the purity is 98% or more; and sodium borate decahydrate: the average particle diameter is about 0.3 mm and the purity is 98% or more.

(Second Component)

Calcium carbonate: the average particle diameter is about 0.1 mm and the purity is 98% or more; and lithium carbonate: the average particle diameter is about 0.3 mm and the purity is 99% or more.

(Third Component)

Fatty acid sodium salt (beef-tallow fatty acid sodium salt): the average particle diameter is about 0.3 mm and the purity is 95% or more; and fatty acid calcium salt (stearic acid calcium salt): the average particle diameter is about 0.4 mm and the purity is 97% or more.

(Fourth Component)

Lamellar silicate 1: talc;

lamellar silicate 2: sodium tetrasilicic mica; and lamellar silicate 3: sericite.

Each of the lamellar silicate has a particle diameter of 0.2 mm or less and of which purity is 90% or more.

Comparative Examples 1 to 7

Each component shown in Table 2 is fed into and mixed in the powder mixer to make the powder lubricant composition for hot metal working. Details of each component are same as the above Examples 1 to 12.

<Evaluation Method>

To the powder lubricant composition for hot metal working produced in Examples 1 to 12 and Comparative examples 1 to 7, evaluation tests of "lubricity at high temperature" and "generating condition of white scale" were carried out.

(Lubricity at High Temperature)

Into an electric furnace ($N_2$ atmosphere) of which temperature is set at 1000° C., a test piece having a size of 150 mm×150 mm×5 mm was placed at an inclination angle of 7 degrees and heated for 10 minutes. On the test piece, the lubricant made as above was provided and these were heated in the electric furnace (air atmosphere) of which temperature is set at 1000° C. for three minutes. Thereafter, the test piece was taken out from the furnace and cooled. Lubricity of each lubricant was evaluated in accordance with the spread of lubricant on each test piece.

◎: it spread extremely well (low viscosity)

○: it adequately spread

Δ: it slightly spread

X: it did not spread or did spread in extremely little area (high viscosity)

(White Scale Generation)

The test piece obtained above was left undisturbed for 30 days and the white scale generation thereon was evaluated in accordance with the following criteria.

◎: no white scale was generated.

○: white scale was hardly generated.

X: white scale was generated.

(Table 2)

TABLE 2

| | Sodium borate | | | Supplemental lubricant | | | | | Fatty acid | | Comprehensive evaluation | |
|---|---|---|---|---|---|---|---|---|---|---|---|---|
| | Anhydrous salt | Pentahydrate | Dechydrate | Calcium carbonate | Sodium carbonate | Lamellar silicate 1 | Lamellar silicate 2 | Lamellar silicate 3 | Sodium salt | Calcium salt | Lubricity | White scale |
| Example 1 | 50 | — | — | — | — | 40 | — | — | — | 10 | ◎ | ◎ |
| Example 2 | — | 80 | — | 5 | — | 10 | — | — | 5 | — | ◎ | ◎ |
| Example 3 | — | — | 30 | 15 | — | 40 | — | — | 15 | — | ◎ | ◎ |
| Example 4 | 50 | — | — | — | — | — | 40 | — | — | 10 | ◎ | ◎ |
| Example 5 | — | 80 | — | 5 | — | — | 10 | — | 5 | — | ◎ | ◎ |
| Example 6 | — | — | 30 | 15 | — | — | 40 | — | 15 | — | ◎ | ◎ |
| Example 7 | 50 | — | — | — | — | — | — | 40 | — | 10 | ◎ | ◎ |
| Example 8 | — | 80 | — | 5 | — | — | — | 10 | 5 | — | ◎ | ◎ |
| Example 9 | — | — | 30 | 15 | — | — | — | 40 | 15 | — | ◎ | ◎ |
| Example 10 | 50 | — | — | — | — | 20 | 20 | — | — | 10 | ◎ | ◎ |
| Example 11 | 50 | — | — | — | — | — | 20 | 20 | — | 10 | ◎ | ◎ |
| Example 12 | 50 | — | — | — | — | 20 | 10 | 10 | — | 10 | ◎ | ◎ |
| Comparative example 1 | — | 66 | — | 15 | — | 9 | — | — | 5 | 5 | ○ | ○ |
| Comparative example 2 | — | 66 | — | 15 | — | — | 9 | — | 5 | 5 | ○ | ○ |
| Comparative example 3 | — | 66 | — | 15 | — | — | — | 9 | 5 | 5 | ○ | ○ |
| Comparative example 4 | 90 | — | — | 4 | — | — | — | — | 6 | — | Δ | ○ |
| Comparative example 5 | — | 90 | — | — | — | — | — | — | 5 | 5 | X | ○ |
| Comparative example 6 | — | — | 84 | — | 6 | — | — | — | 5 | 5 | ○ | X |
| Comparative example 7 | 90 | — | — | 4 | — | — | — | — | 6 | — | Δ | ○ |

<Evaluation Results>

As shown in Table 2, the powder lubricant composition for hot metal working of the present invention (Examples 1 to 12) shows excellent results in lubricity and generating condition of white scale. Meanwhile, the powder lubricant composition for hot metal working of the Comparative examples 1 to 3 has smaller content of the lamellar silicate compound of the fourth component than that of the present invention. Therefore, performance of lubricity and inhibiting generation of white scale is inferior. Moreover, the powder lubricant composition for hot metal working of the Comparative examples 4 to 7 has larger content of sodium borate of the first component than that of the present invention, and it does not contain the lamellar silicate compound of the fourth component. As a consequence, performance of lubricity and inhibiting generation of white scale is inferior. Further, particularly, the powder lubricant composition for hot metal working of the Comparative example 6 contains sodium carbonate instead of calcium carbonate as the second component. Thus, crystallization of sodium borate is caused and then white scale was generated.

Examples 13 to 15

Each component shown in Table 3 is fed into and mixed in the powder mixer to make the powder lubricant composition for hot metal working of the invention. Details of each component are same as the above Examples 1 to 12.

Comparative examples 8 to 10

Each component shown in Table 3 is fed into and mixed in the powder mixer to make the powder lubricant composition for hot metal working. Details of each component are same as the above Examples 1 to 12.

<Evaluation Method>

With the powder lubricant composition for hot metal working made in the Examples 13 to 15 and the Comparative examples 8 to 10, operation of actual production line was carried out by using a five-stand full-retractable mandrel mill. As a workpiece, a hollow shell made of common steel was used. Dimension of the hollow shell before rolling was 330 mm in outer diameter, 18 mm in pipe wall thickness, and 7000 mm in length. Temperature of the hollow shell before rolling was set at 1150° C. Mandrel bar used in the process was 258 mm in outer diameter, 24000 mm in length; the material is SKD6; and surface thereof was plated with chromium (50 μm). Then, drawing-rolling was carried out such that dimension of the finished pipe products after mandrel mill rolling was to become 276 mm in outer diameter, 8 mm in pipe wall thickness, and 18300 mm in length.

As the method for injecting lubricant, 1100 cc of lubricant was blown from one end of pre-rolled hollow shell by injecting nitrogen carrier gas of $1.47\times10^5$ Pa.

(Friction Coefficient)

Friction coefficient at a time of mandrel mill rolling was evaluated as a value where retained force of a mandrel bar is divided by a sum of each stand load in accordance with the following criteria.

◎: friction coefficient is less than 0.025.

○: friction coefficient is 0.025 or more and less than 0.03.

X: friction coefficient is 0.03 or more.

(White Scale Generation)

The finished pipe obtained as above was left undisturbed for 30 days and the generation of white scale thereon was evaluated in accordance with the criteria.

◎: no white scale was generated.

○: white scale was hardly generated.

X: white scale was generated.

(Table 3)

TABLE 3

| | Sodium borate | | | Supplemental lubricant | | | | | Fatty acid | | Comprehensive evaluation | |
|---|---|---|---|---|---|---|---|---|---|---|---|---|
| | Anhydrous salt | Pentahydrate | Dechydrate | Calcium carbonate | Sodium carbonate | Lamellar silicate 1 | Lamellar silicate 2 | Lamellar silicate 3 | Sodium salt | Calcium salt | Friction coefficient | White scale |
| Example 13 | 50 | — | — | 10 | — | 30 | — | — | — | 10 | ◎ | ◎ |
| Example 14 | — | 50 | — | 10 | — | — | 30 | — | — | 10 | ◎ | ◎ |
| Example 15 | — | — | 50 | 10 | — | — | — | 30 | — | 10 | ◎ | ◎ |
| Comparative example 8 | 65 | — | — | 20 | — | — | — | — | 7.5 | 7.5 | ○ | ○ |
| Comparative example 9 | 65 | — | — | 20 | — | — | — | — | 7.5 | 7.5 | ○ | ○ |
| Comparative example 10 | — | 65 | — | — | 20 | — | — | — | 7.5 | 7.5 | ○ | X |

<Evaluation Results>

As shown in Table 3, the powder lubricant composition for hot metal working of the present invention (Examples 13 to 15) shows excellent results in friction coefficient and generation of white scale. On the other hand, about the Comparative examples 8 to 10, lamellar silicate as the fourth component is not contained in the lubricant composition. So, lubricity is deteriorated, and effect for inhibiting generation of white scale is reduced. Further, particularly, about the Comparative example 10, sodium carbonate is contained instead of calcium carbonate as the second component. Therefore, sodium borate is crystallized, thereby white scale is generated.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that lubricant for hot metal working, powder lubricant composition for hot metal working, and method for manufacturing seamless pipe with such an alternation are included in the technical scope of the invention.

The invention claimed is:

1. A method for inhibiting crystallization of a lubricant composition during the process of mandrel mill rolling for drawing-tolling a hollow shell wherein the lubricant composition contains sodium borate as a main component and is adhered to the inner surface of said hollow shell, the method comprising the step of:

adding a silicate compound to the lubricant composition.

2. The method for inhibiting crystallization of a lubricant composition according to claim 1, wherein said silicate compound is a lamellar silicate compound.

3. A powder lubricant composition for hot metal working comprising:

a first component being one or more compounds selected from a group consisting of anhydride, pentahydrate, and decahydrate of sodium borate;

a second component comprising calcium carbonate and/or lithium carbonate;

a third component comprising fatty acid sodium salt and/or fatty acid calcium salt; and a fourth component containing a lubricant for hot metal working comprising a silicate compound, wherein the content ratio of each component, to total mass of said first to fourth components as 100%, is: 30 to 80 mass % of said first component; 0 to 15 mass % of said second component; 5 to 15 mass % of said third component; and 10 to 40 mass % of said fourth component.

4. The powder lubricant composition for hot metal working according to claim 3, wherein said lubricant for hot metal working is a lubricant for hot metal working comprising a silicate compound used for hot metal working added to a lubricant composition mainly containing sodium borate.

5. The powder lubricant composition for hot metal working according to claim 3, wherein said hot metal working is mandrel mill rolling for drawing-rolling a hollow shell and said lubricant composition is a lubricant for inner surface lubrication by adhering onto the inner surface of said hollow shell.

6. The powder lubricant composition for hot metal working according to claim 3, wherein said silicate compound is a lamellar silicate compound.

7. A method for manufacturing seamless pipe, the method comprising the steps of:

adhering a powder lubricant composition for hot metal working according to claim 3 or 4 onto the inner surface of a hollow shell; and drawing-rolling said hollow shell.

* * * * *